US005203456A

United States Patent [19]

Boswell

[11] Patent Number: 5,203,456

[45] Date of Patent: Apr. 20, 1993

[54] CURLING IRON TRAVEL CASE

[76] Inventor: Rudy Boswell, 4316 Pickfair, Springfield, Ill. 62703

[21] Appl. No.: 738,457

[22] Filed: Jul. 31, 1991

[51] Int. Cl.[5] ..... B65D 85/20

[52] U.S. Cl. ..... 206/349; 219/225; 248/117.6

[58] Field of Search ..... 206/320, 349; 219/222, 219/225, 242; 132/229, 232; 126/408; 248/117.1-117.7

[56] References Cited

U.S. PATENT DOCUMENTS

| | | | |
|---|---|---|---|
| D. 217,316 | 4/1970 | Cassidy | D86/10 |
| D. 218,869 | 9/1970 | Mercer | D86/10 |
| D. 220,151 | 3/1971 | Waters | D86/10 |
| D. 264,274 | 5/1982 | Raab | D3/39 |
| D. 270,671 | 9/1983 | Yamamoto | D28/38 |
| 1,141,272 | 6/1915 | Schuller | 248/117.3 |
| 1,466,139 | 8/1923 | Michie | 219/242 X |
| 1,530,352 | 3/1925 | Cook | 219/225 X |
| 1,707,487 | 4/1929 | Langiaux | 248/117.5 |
| 2,439,004 | 4/1948 | Hurley | 248/117.1 |
| 3,371,975 | 3/1968 | Meltzer | 206/349 X |
| 3,534,392 | 10/1970 | Trouilhet | 219/242 X |
| 3,600,552 | 8/1971 | Tolmie | 219/222 |
| 3,646,316 | 2/1972 | Volosin et al. | 219/222 |
| 3,815,614 | 6/1974 | Waters et al. | 206/349 X |
| 4,267,430 | 5/1981 | Downey | 219/222 |
| 4,308,878 | 1/1982 | Silva | 219/242 X |
| 4,354,093 | 10/1982 | Zago | 219/225 |
| 4,516,001 | 5/1985 | Jeffress et al. | 219/222 |
| 4,570,792 | 2/1986 | Conway | 206/349 |
| 5,062,529 | 11/1991 | Blair | 206/349 |

*Primary Examiner*—Bryon P. Gehman
*Attorney, Agent, or Firm*—Heller & Kepler

[57] ABSTRACT

The curling iron travel case generally consists of a base, the base having a bottom, an open top, back, left side, right side and front. The base also may contain a power block within the base near the front. The power block can include multiple receptacles, a power cord, a power switch, circuit breaker or fuse.

A cover is pivotally hinged to the back of the base. The cover has a top, an open bottom, back, left side, right side and front. The open bottom of the cover fitting over the open top of the base. A mirror and a light may be attached to the inside of the cover.

A support member for receiving multiple curling irons is installed within the base. The support member includes multiple elongated troughs for receiving multiple curling irons and a structure along the troughs for attaching a hold down clamp and stand.

The hold down clamp and stand contains a soft compressible material for securing a curling iron to the support member when the hold down clamp and stand is attached to the support member. The hold down clamp and stand has an arched member for holding a curling iron when the curling iron is in use.

A heat resistant sleeve is contained on the support member near the back of the base. The heat resistant sleeve has a hollow area for receiving a tip of a curling iron near the rear of the support member and an arched area for holding a tip of a curling iron when the curling iron is in use.

13 Claims, 6 Drawing Sheets

CURLING IRON TRAVEL CASE

BACKGROUND OF THE INVENTION

The present invention relates to a curling iron travel case and more particularly to a travel case which houses a plurality of curling irons and provides a rest for the curling irons when in use.

Curling irons are well known and in wide use. They can be and are in daily use by women throughout the nation and the world. The curling iron is commonly packed in suit cases and travel bags when traveling. Usually, the curling irons are just stuffed into the suit case or travel bag with the cord wrapped around the body or handle of the curling iron.

Casual packing is both harmful to the curling iron and a possible hazard to the contents of the suitcase or travel bag. Additionally, the curling iron must be cooled prior to packing it into the suitcase or bag. Therefore, there exist a need for a means to safely carry a curling iron when traveling.

It is common for more than one curling iron to be heated and used during hair preparation. Therefore, more than one curling iron is typically heated up and used. Presently, there is no convenient device available to provide for working support and electrical connection to a plurality of curling irons. Furthermore, a bathroom receptacle may be overloaded with curling iron cords.

In the prior art, there are several types of carrying devices and apparatuses for steaming hair rollers and several designs for carrying cases for miscellaneous type of apparatuses. The prior art does not specifically provide for a travel case for curling irons which, besides being a travel case, provides a power section, a rest for the curling irons when in use, provides for a plurality of curling irons and functions as a vanity case and mirror when traveling.

SUMMARY OF THE INVENTION

Accordingly, it is an object of the curling iron travel case of this invention is to provide a travel case for safely carrying a plurality of curling irons when traveling.

Another object of the curling iron travel case is to provide a curling iron travel case which can store and carry a curling iron immediately after use, when the barrel of the curling iron may still be hot from use.

Yet another object of the curling iron travel case is to provide a rest and holder for a single curling iron or plurality of curling irons when in use.

A further object of the curling iron of this invention is to provide a means to supply power to a plurality of curling irons or other devices with a care towards overloading the electrical circuits.

Still a further object of the curling iron travel case of this invention is to provide a vanity case and mirror for use when traveling.

To accomplish the foregoing and other objects of this invention there is provided a curling iron travel case and more particularly a travel case which houses a plurality of curling irons and provides for a rest for the curling irons when in use.

The curling iron travel case generally consists of a base, the base having a bottom, an open top, back, left side, right side and front.

The base also may contain a power block within the base near the front. The power block can include multiple receptacles, a power cord, a power switch, circuit breaker or fuse.

A cover is pivotally hinged to the back of the base. The cover has a top, an open bottom, back, left side, right side and front. The open bottom of the cover fitting over the open top of the base. A mirror and a light may be attached to the inside of the cover.

A support member for receiving multiple curling irons is installed within the base. The support member includes multiple elongated troughs for receiving multiple curling irons and a clamping means along the troughs for attaching a hold down clamp and stand.

The hold down clamp and stand contains a soft compressible material for securing a curling iron to the support member when the hold down clamp and stand is attached to the support member. The hold down clamp and stand has an arched member for holding a curling iron when the curling iron is in use.

A heat resistant sleeve is contained on the support member near the back of the base. The heat resistant sleeve has a hollow area for receiving a tip of a curling iron near the rear of the support member and an arched area for holding a tip of a curling iron when the curling iron is in use.

In operation, the housing provides for storage and transport of a plurality of curling irons that may be used during hair preparation. Typically, more than one curling iron is heated up and used. Therefore, the curling iron travel case of this invention provides for working support, electrical connection, storage and traveling case for a plurality of curling irons.

These and other objects and features of the present invention will be better understood and appreciated from the following detailed description of one embodiment thereof, selected for purposes of illustration and shown in the accompanying drawings.

DETAILED DESCRIPTION

Figure 1:
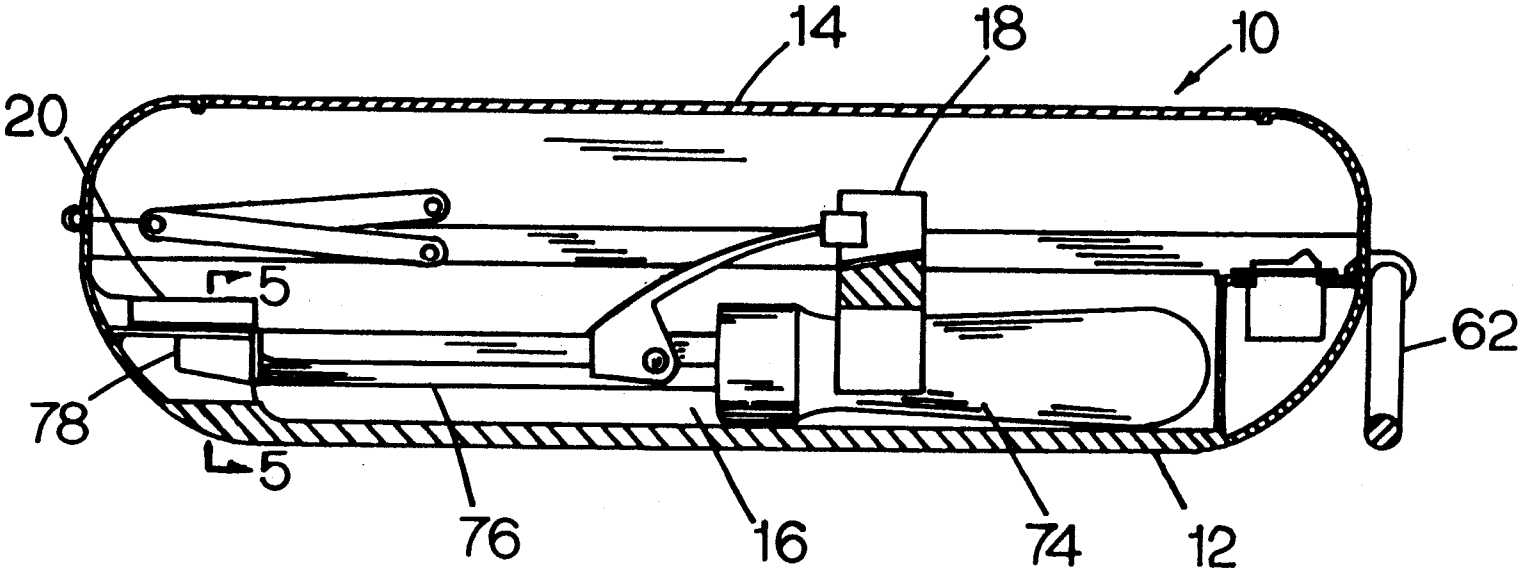
FIG. 1 is an illustration of one embodiment of a curling iron housing constructed in accordance with the present invention.
Figure 2:
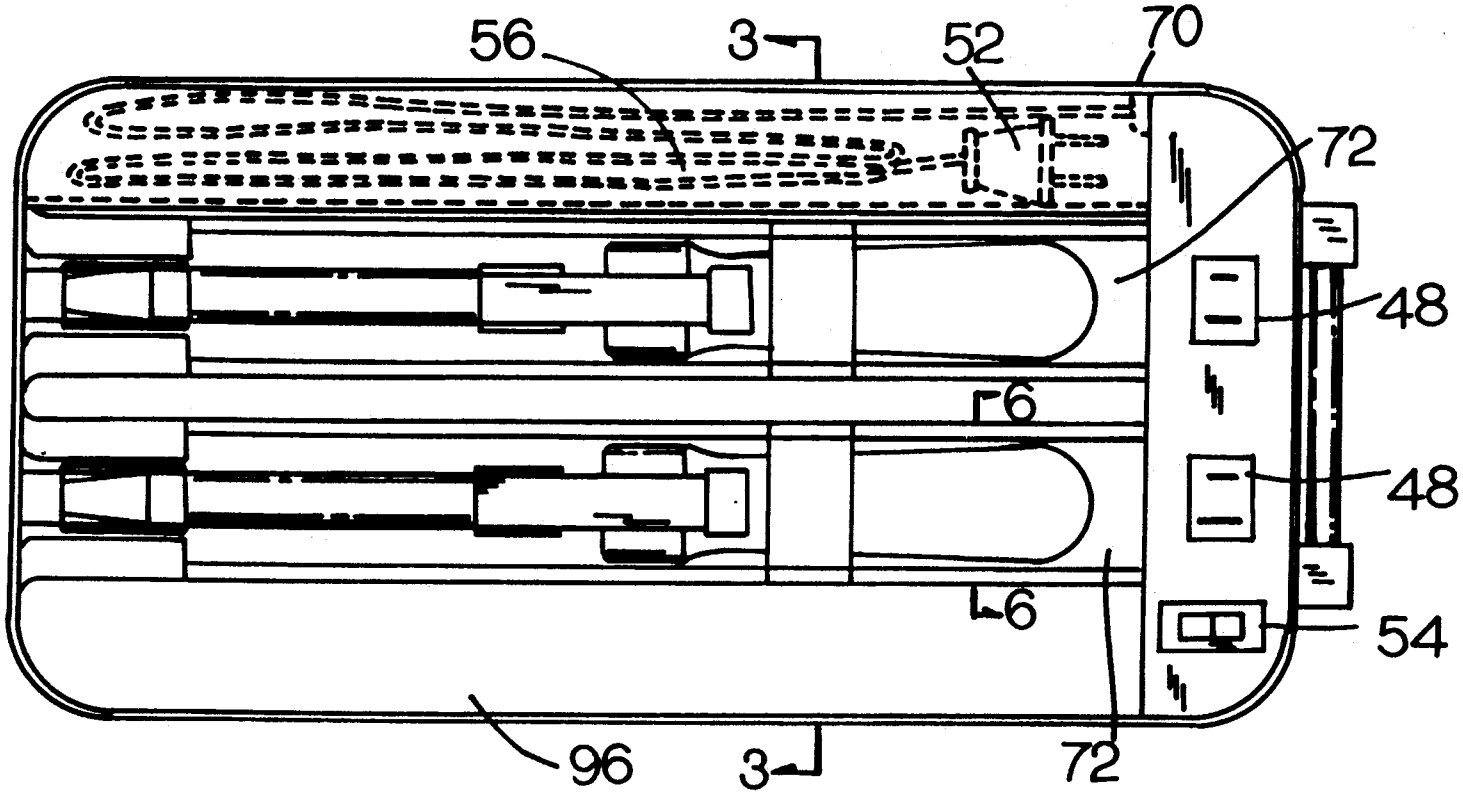
FIG. 2 is a top view of the base of the housing depicted in FIG. 1.
Figure 3:
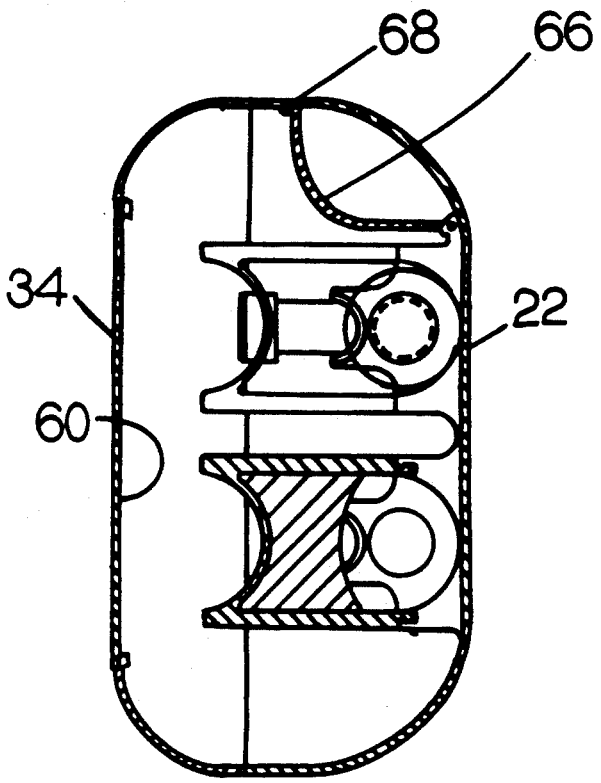
FIG. 3 is a cross-sectional view taken along line 3—3 in FIG. 2.
Figure 8:
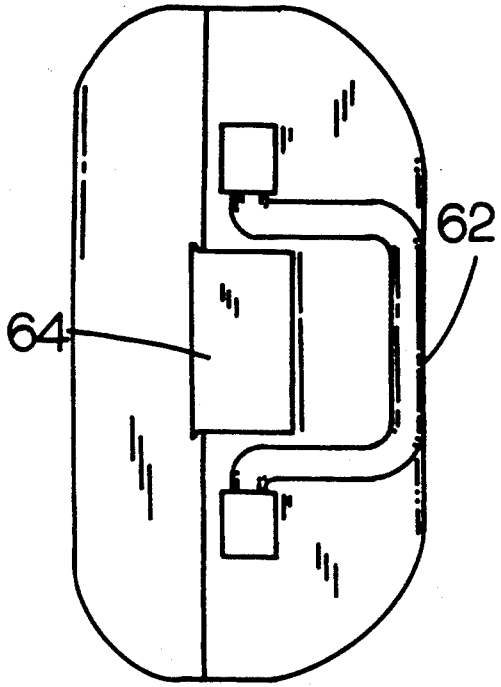
FIG. 8 is a front view of the curling iron travel case with the cover closed.
Figure 7:
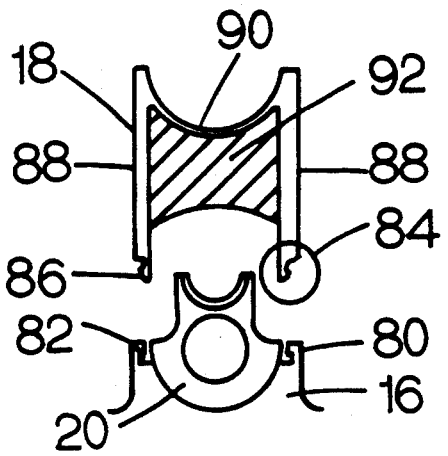
FIG. 7 is a cross-sectional view of a hold-down clamp and stand adjacent a cross-section view of the support member depicted in FIG. 6.
Figure 4:
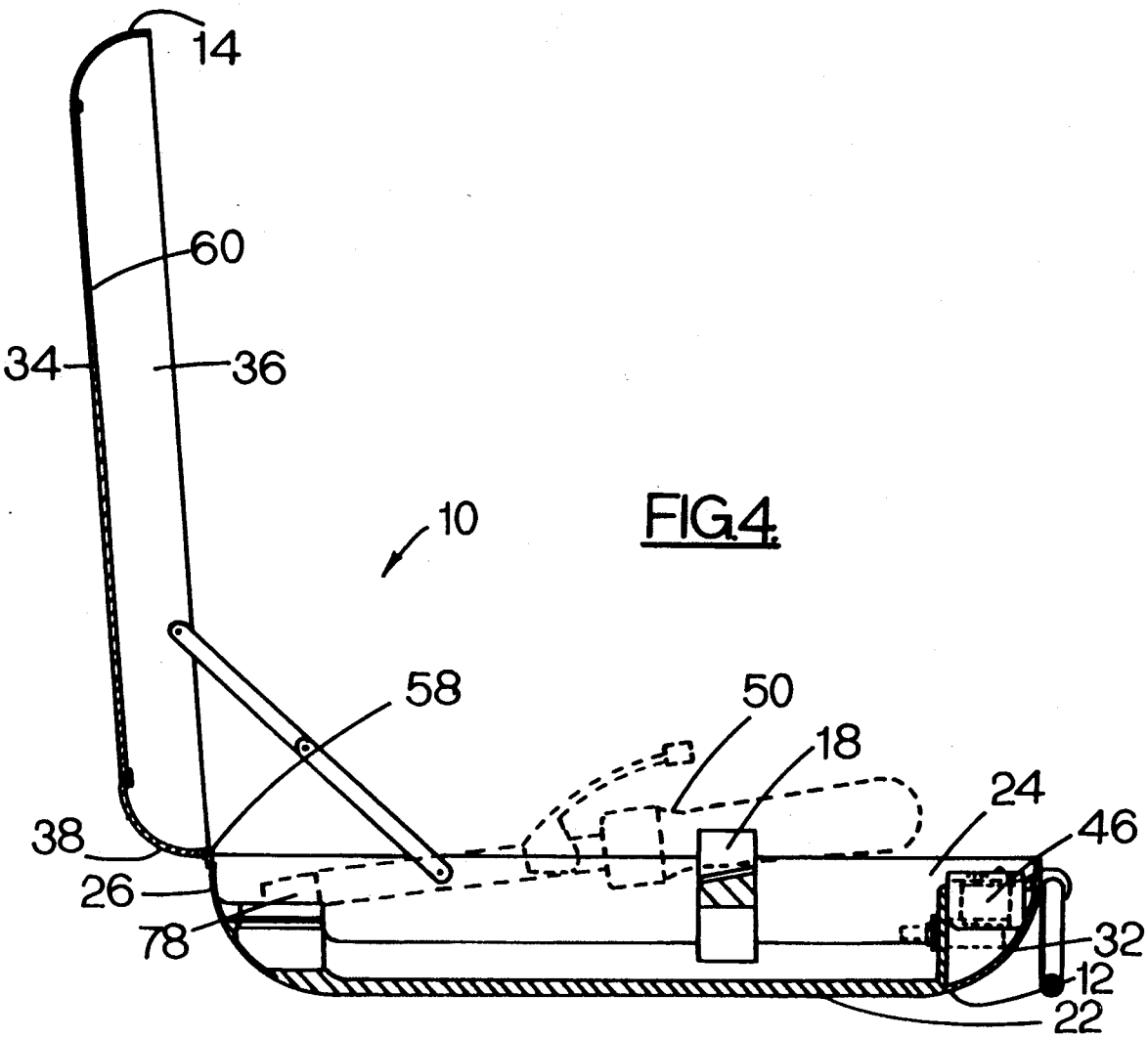
FIG. 4 is a side view with the cover in a raised position taken along line 4—4 in FIG. 9.
Figure 6:
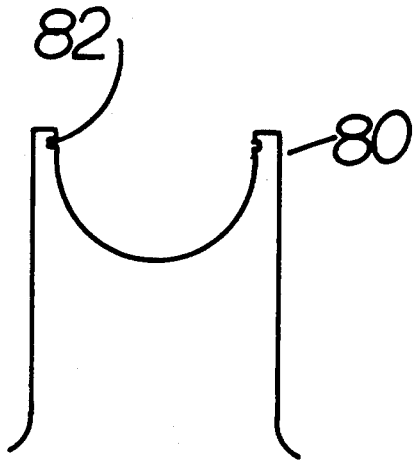
FIG. 6 is a cross-sectional view of a support member taken along line 6—6 in FIG. 1.
Figure 5:
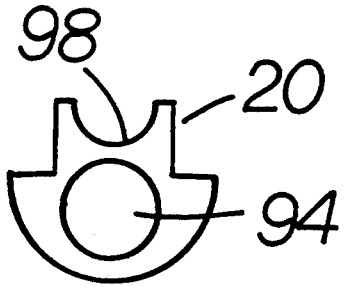
FIG. 5 is a cross-sectional view of the heat resistant sleeve taken along line 5—5 in FIG. 1.
Figure 9:
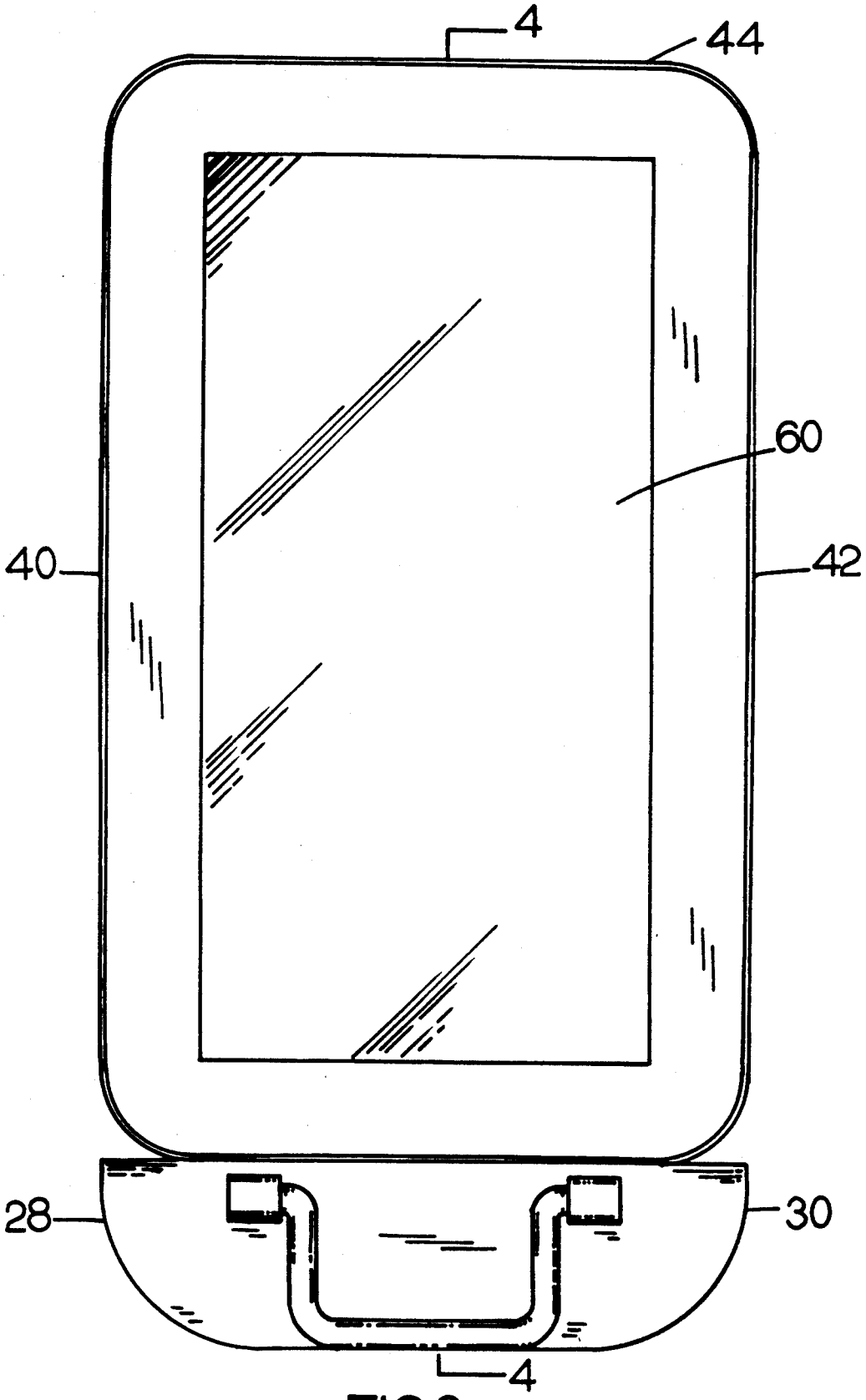
FIG. 9 is a front view of the curling iron travel case showing the cover in a raised position.

Referring now to the drawings in general there is shown the preferred embodiment for the curling iron travel case 10 of this invention. The curling iron travel case 10 basically consists of a base 12, a cover 14, a support member 16, a hold down clamp and stand 18 and a heat resistant sleeve 20.

The base 12 contains a bottom 22, an open top 24, back 26, left side 28, right side 30 and front 32. In the preferred embodiment, the shape of the base 12 is generally rectangular. The base 12 being sized to contain multiple curling irons 50. The base 12 is typically made of high impact plastic material, but other material such as aluminum could be used. The base 12 has rounded edges for aesthetics, safety and strength.

A cover 14, having a top 34, an open bottom 36, back 38, left side 40, right side 42 and front 44, is attached to the base 12 by a hinge 58. The hinge 58 is typically attached to the back 26 of base 12 and the back 38 of cover 38. The cover 14 is constructed having the same general shape as the base 12, such that the open bottom 36 matches and covers the open top 24 of base 12. The cover 14 is constructed from the same material as the base 12. The cover 14 also has rounded edges for aesthetics, safety and strength.

A mirror 60 may be attached to the inside of the top 34 of the cover 14. The mirror can be attached by glue, two sided tape, holding tabs molded in the cover 14 when constructed or molded, or any other means known in the art.

In another embodiment of the curling iron travel case, a light may be installed within the cover 14 or base 12. The light would typically be wired into the power block 46 and either have a separate switch or be wired to the power switch 54.

A handle 62 is provided to conveniently carry the curling iron travel case 10. The handle, in the preferred embodiment, is attached to the front 32 of the base 12. Typically the handle 62 is pivotally attached as is common in most type of carrying cases and suit cases.

A means of securing the cover 14 to the base 12 is provide. The typical means is a latch 64. A wide variety of different types of latches are available, any of which may be used in accordance with the design of the curling iron travel case 10 of this invention. The particular type would be dependent upon the material of which the base 12 and cover 14 are constructed.

In the preferred embodiment, the latch 64 is molded as a part of the base 12 and a part of the cover 14. The particular means of attaching the latch 64 being determined by the particular type of latch used and the construction material of the base 12 and cover 14. The latch 64 is typically located the side opposite the hinge 58. As illustrated the latch 64 is attached to the front 32 of base 12 and to the front 44 of cover 14.

A power block 46 may be contained within the base 12, as illustrated in FIG. 1 of the preferred embodiment of this invention. The power block 46 is typically contained within the base 12 near the front 32. The power block 46 typically has multiple receptacles 48, a power cord 52 and a power switch 54. The number of receptacles 48 typically contained in the power block 46 would be determined by the number of curling irons 50 which the curling iron travel case 10 can store and transport.

A conventional fuse or circuit breaker (not illustrated) could also be included in the power block 46 without departing from the scope and spirit of the invention. A fuse or circuit breaker would be added as an additional safety feature or to meet particular safety codes, regulations or to obtain certifications.

The power block 46 in the preferred embodiment is constructed from a high impact plastic material. Other materials could be used without departing from the invention herein described. The material of which the power block 46 is constructed is preferably nonconductive in the event of an electrical short within the power block 46.

The power block 46 can be designed to snap into the base 12. This requires that some sort of snap in tabs or slots be included during the construction of the base 12 and the power block 46. The power block 46 could also be attached within the base 12 by glue, screws, rivets, or any other attachment means appropriate for the design and which meet pertinent design codes.

A power cord compartment 56 is provided within base 12 of the curling iron travel case 10. The compartment is typically defined by an easily removable lid 66. The lid 66, as illustrated in the preferred embodiment, snaps into the base 12 near the right side 30. However, the particular location and means of securing the lid 66 to the base 12 can be altered to suit the particular design, layout, choice of materials and method of manufacture.

In the preferred embodiment depicted for purposes of this description, the lid 66 snaps into lips 68 molded into the plastic base 12 during construction. The power cord 52 is wrapped and fitted into the compartment 56 for storage and transport.

A slot 70 may be provided through which the power cord 52 may extend. The slot 70 would typically be located along the edge of the base 12 near the compartment 56, such that it would be readily available to extend the power cord 52 from the curling iron travel case 10.

A support member 18 is installed within the base 12. The support member 18 contains multiple elongated troughs 72 for receiving curling irons 50. Each trough 72 receiving a single curling iron 50. The number of troughs 72 determining the number of curling irons 50 which may be stored and transported in the curling iron travel case 10. The troughs 72 have a general shape of a half cylinder with a radius sufficiently large to receive a curling iron 50.

Curling irons 50 are manufactured by several different manufacturers and many models are available. However, the typical curling iron 50 has a circular shaped handle 74 and an elongated cylindrical shaped barrel 76 having a tip 78. The particular diameter of the handle and the overall length and dimensions of the curling iron are determined by the manufacture and the design of the present invention may be modified to suit other curling irons not described or illustrated within the scope of the present invention.

The troughs 72 are thus, of a sufficient radius to accommodate the majority of curling irons 50 on the market. The overall length of the base 12, cover 14 and support member 72 also are of sufficient length to accommodate the majority of curling irons 50 on the market.

The support member 16 contains a clamping means 80 along both sides of each of the troughs 72. The clamping means 80 provide a mechanism for attaching the hold down clamp and stand 18 to the support member 16.

In the preferred embodiment as illustrated, the clamping means 80 consists of an indentation 82 parallel to and along the inside edges of both sides of each trough 72. The clamping means receive the reciprocal clamping means 84 contained on the hold down clamp and stand 18.

In the preferred embodiment as illustrated, the clamping means 84 on the hold down clamp and stand 18 consists of a tab 86 which fits into the indentation 82 of clamping means 80. Thus, the hold down clamp and stand 18 is "snapped" into position and secured to the support member 16.

The hold down clamp and stand 18 provides a dual function. The first function is to clamp a curling iron 50 securely in the trough 72 in the support member 16. The second is to provide a stand for the curling iron 50 such that the handle 74 of the curling iron 50 can be readily grabbed when in use.

The hold down clamp and stand 18 in the preferred embodiment consists of parallel side walls 88 joined at one end by a generally concave arched member 90. The clamping means 84 being at the end of each of the parallel side walls 88 and opposite the arched member 88. A compressible material 92 is contained within the hold down clamp and stand 18 between the parallel side walls 88.

The compressible material 92 conforms to the shape of the handle 74 of the curling iron 50 when clamped into the trough 72 within the support member 16 of curling iron travel case 10. The compressible material 92 is typically constructed from neoprene rubber in the preferred embodiment, however, other material may be utilized without departing from the inventive concepts herein described.

The arched member 90 of the hold down clamp and stand generally has a radius similar to the radius to the trough 72. The arched member receives the handle 74 of the curling iron 50. The handle 74 rests upon the arched member 90 when the curling iron 50 is in use. The hold down clamp and stand 90 hold the curling iron 50 in a position such that the handle 74 can be readily grabbed.

A heat resistant sleeve 20 is contained on the support member 16 near the back 26 of the base 16. The heat resistant sleeve 20 has a hollow area 94 for receiving a tip 78 of a curling iron 50 during storage and transport, and an arched area 98 for holding a tip 78 of a curling iron 50 when the curling iron 50 is in use.

Typically, the heat resistant sleeve 20 is made from a ceramic material. However, any heat resistant material, which is light, strong and capable of containing a hollow area 94 and an arched area 98 could be substituted.

The hollowed area 94 in heat resistant sleeve 20 is sized to accommodate the tip 78 of the majority of curling irons 50 on the market. Thus, the hollow area 94 has a diameter slightly larger than the diameter of the tip 78 of the largest curling iron 50 on the market. The arched area 98 has a diameter approximately the same diameter as the hollow area 94.

In operation, a plurality of curling irons can be stored and transported in the curling iron travel case 10 of this invention. The cover 14 is opened and the hold down clamp and stand 18 is removed from the support member 16.

Curling irons 50 are placed in the troughs 72 such that the tip 78 of the curling iron 50 rests within the hollow area 94 of the heat resistant sleeve 20. The hold down clamp and stand is then placed over the handle 74 of the curling iron 50 such that the compressible material 92 is in contact with the handle 74. The hold down clamp and stand is then clamped onto the support member 16 via clamping means 80 and 84.

The compressible material 92 conforms to the shape of the handle 74 and secures the curling iron 50 in the trough 72. The cords of the curling iron 50 are wrapped and placed in an open area 96 within the base 12 of the curling iron travel case 10 opposite the compartment 56. This is repeated for each curling iron 50. The cover 14 is then closed and secured with latch 64. The curling irons 50 can now be safely stored or transported in the curling iron travel case.

One curling iron 50 is placed in each trough 72. The support member 16 contains a multiple of troughs 72. Thus, the number of curling irons 50 that the curling iron travel case 10 can store and transport is determined by the number of troughs 72.

Additionally, the curling irons can be placed in the curling iron travel case 10 when the barrel 76 and tip 78 of the curling iron 50 is still hot from use. The tip 78 is safely contained within the hollow area 94 of the heat resistant sleeve 20 and nothing within the curling iron travel case 10 is in contact with the hot barrel 76 of curling iron 50.

In use, the cover 14 is opened and the hold down clamp and stand 18 is removed to free the curling iron 50. The curling iron 50 is lifted from the trough 72 and the hold down clamp and stand 18 is replaced. The curling iron 50 can then be placed in a resting position, the handle 74 resting upon the arched member 90 on the hold down clamp and stand 18 and the tip 78 resting on the arched area 98 on the heat resistant sleeve 20.

The power cord of the curling iron 50 is plugged into the receptacle 48 on the power block 46. The power cord 52 of the power block 46 is plugged into a household outlet, typically in a bathroom or other room where the curling irons are to be used. The power switch 54 is placed in the "on" position and the curling irons 50 are ready to be used.

In the preferred embodiment shown and described the curling iron travel case 10 contains two troughs 72 for transporting and storing two curling irons 50. This is probably the more common number of curling irons 50 when multiple curling irons are used. A case approximately 7½" wide and approximately 1541 long and approximately 4" high (outside dimensions) should provide sufficient interior room for two curling irons and associated power cord, plugs, and switches.

The curling iron travel case 10 of this invention could be modified to accommodate one curling iron or more than two curling irons 50. The size of the base 12, cover 14 and the details of the power block 46, support member 16 and other components would have to be altered to accommodate the additional number. Other dimensions, materials and construction may also be changed, altered or modified without departing from the spirit or scope of the inventive concepts herein described and illustrated.

From the foregoing description those skilled in the art will appreciate that all of the objects of the present invention are realized. A curling iron travel case has been shown and described for providing the desired travel case for safely carrying one or a plurality of curling irons when traveling or for home use.

The curling iron travel case provides storage of a curling iron after use, such as when the barrel of the curling iron remains hot from use, while the curling iron cools. The curling iron travel case provides a rest and holder for a single curling iron or plurality of curling irons.

The curling iron travel case of the present invention provides a means to supply power to a plurality of curling irons or other devices with a care regarding overloading the electrical circuits. The curling iron travel case of this invention provides a vanity case and mirror.

While specific embodiments have been shown and described, many variations are possible. The particular shape of the housing and the components including all the dimensions may be changed as desired to suit the curling irons, size, shape, and number with which it is used. The housing materials may vary although plastic is preferred.

The configuration and number of curling irons included may vary although the preferred embodiment shows two curling irons. In a more simplified version of the invention, the interior arrangement may be modified for receive only the one curling iron.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of this invention be determined by the appended claims and their equivalents.

What is claimed is:

1. A curling iron travel case comprising: a base structure, the base structure having a bottom, back, left side, right side, front and open top;

a cover structure pivotally hinged to the back of the base structure, the cover structure having a top, back, left side, right side, front and open bottom;

a support member installed within the base structure;

a hold down clamp and stand attachable to the support member;

a heat-resistant sleeve contained on the support member near the back of the base structure; and the hold down clamp and stand further comprises a soft compressible a material contained within the hold down clamp and stand for securing a curling iron to the support member when the hold down clamp and stand is attached to the support member, and an arched area for holding a curling iron when the curling iron is in use.

2. A curling iron travel case as set forth in claim 1 which further comprises a power block contained within the base structure near the front, the power block having multiple receptacles and a power cord.

3. A curling iron travel case as set forth in claim 2 in which the power block further comprises a power switch on the power block.

4. A curling iron travel case as set forth in claim 2 in which the power block further comprises a fuse.

5. A curling iron travel case as set forth in claim 2 in which the power block further comprises a fuse.

6. A curling iron travel case as set forth in claim 1 in which the cover further comprises a mirror contained within an insert within the cover.

7. A curling iron travel case as set forth in claim 1 in which the heat resistant sleeve contains a hollow area for receiving a tip of a curling iron on one side of the support member.

8. A curling iron travel case as set forth in claim 7 in which the heat resistant sleeve further comprises an arched area for holding a tip of a curling iron when the curling iron is in use.

9. A curling iron travel case as set forth in claim 1 in which the curling iron support member further comprises multiple elongated troughs for receiving multiple curling irons and a clamping means along the troughs for attaching the hold down clamp and stand to the support member.

10. A curling iron travel case as set forth in claim 9 in which the clamping means further comprises an indentation along both sides of each of the troughs for receiving clamping tabs contained on the hold down clamp and stand.

11. A curling iron travel case as set forth in claim 1 in which the soft compressible material consists of neoprene rubber.

12. A curling iron travel case as set forth in claim 1 in which the base further contains a carrying handle and a latch for securing the cover to the base.

13. A curling iron travel case comprising:

a base structure, the base structure having a bottom, back, left side, right side, front and open top, further containing a power block within the base structure near the front, the power block having multiple receptacles, a power cord and a power switch;

a cover structure pivotally hinged to the back of the base structure, the cover structure having a top, back, left side, right side, front and open bottom;

a support member installed within the base structure, the support member having multiple elongated troughs for receiving multiple curling irons and a clamping means along the troughs for attaching the hold down clamp and stand;

a hold down clamp and stand attachable to the support member, the hold down clamp and stand having a soft compressible material contained within the hold down clamp and stand for securing a curling iron to the support member when the hold down clamp and stand is attached to the support member, and an arched area for holding a curling iron when the curling iron is in use; and a heat resistant sleeve contained on the support member near the back of the base, the heat resistant sleeve having a hollow area for receiving a tip of a curling iron on one side of the support member and an arched area for holding a tip of a curling iron when the curling iron is in use.

* * * * *